US005131881A

United States Patent [19]

Okada

[11] Patent Number: 5,131,881

[45] Date of Patent: Jul. 21, 1992

[54] LIFT TOY

[75] Inventor: Masatoshi Okada, Tokyo, Japan

[73] Assignee: Tomy Company, Ltd., Tokyo, Japan

[21] Appl. No.: 644,575

[22] Filed: Jan. 23, 1991

[30] Foreign Application Priority Data

Jan. 23, 1990 [JP] Japan ..... 2-4768

[51] Int. Cl.[5] ..... A63H 33/30; A63H 17/06; A63H 33/00; A63H 18/14

[52] U.S. Cl. ..... 446/424; 446/428; 446/475; 446/489; 446/445

[58] Field of Search ..... 446/423, 424, 425, 426, 446/427, 428, 429, 447, 467, 471, 475, 477, 483, 489, 491, 130, 441, 444, 445, 122, 91, 94

[56] References Cited

U.S. PATENT DOCUMENTS

| | | | |
|---|---|---|---|
| 898,112 | 9/1908 | Joehnek | 446/427 X |
| 1,217,865 | 2/1917 | Harris | 446/427 |
| 2,522,133 | 9/1950 | Sanders | 446/171 |
| 2,686,385 | 8/1954 | Smith et al. | 446/424 X |
| 3,426,474 | 2/1969 | Einfalt | 446/428 |
| 3,721,035 | 3/1973 | Goldfarb | 446/172 |
| 3,721,036 | 3/1973 | Goldfarb | 446/489 X |
| 3,789,538 | 2/1974 | Spengler et al. | 446/423 X |
| 4,150,507 | 4/1979 | Ogagawara | 446/424 X |
| 4,312,149 | 1/1982 | Iwao | 446/426 X |
| 4,878,869 | 11/1989 | Yamane et al. | 446/130 |

FOREIGN PATENT DOCUMENTS

| | | | |
|---|---|---|---|
| 1091017 | 10/1960 | Fed. Rep. of Germany | 446/424 |
| 2333410 | 7/1977 | France | 446/444 |
| 55-9995 | 3/1980 | Japan . | |
| 1519749 | 8/1978 | United Kingdom . | |

*Primary Examiner*—Robert A. Hafer
*Assistant Examiner*—D. Neal Muir
*Attorney, Agent, or Firm*—Staas & Halsey

[57] ABSTRACT

A toy is provided for lifting goods onto a stand-by portion and discharging them from the stand-by portion in response to the passing of an object. A goods lifting portion is pivotably supported by a vertical support member at a pivot point. A receiving portion is located at one end radially extending from the pivot point. An extension member is located at a second end radially extending from the pivot point for upwardly pivoting the receiving portion to empty the goods from the receiving portion onto the stand-by portion when the support member reaches a predetermined vertical distance. A contact member provides a force upon the passing of an object. A separating and discharging member rotatingly receives goods of a predetermined quantity from the stand-by portion and discharges the goods when the contact member provides the force. A retaining member disables the separating and discharging member when both positionally moved to a predetermined position and the absence of a magnetic force is detected.

14 Claims, 7 Drawing Sheets

LIFT TOY

BACKGROUND OF THE INVENTION

1. Field of the Invention

The present invention relates to a lift toy for lifting goods onto a stand-by portion by operation of a handle and then discharging the goods from the stand-by portion.

2. Description of the Related Art

Heretofore there has been a lift toy for lifting goods by operating a handle. In this known lift toy, however, the amount of displacement of a handle made by the operation thereof and the amount of a vertical displacement of a goods receiving member based on the operation were in a 1:1 relation, and thus there was no strangeness, so the toy was simple and the player was apt to lose interest in it.

Additionally, for example, Japanese Utility Model Publication No. 9995/80 discloses an unloading toy. In the unloading toy, goods were first placed on a stand-by deck. Then, every time a traveling body passed the unloading portion side, the traveling body abutted a contact-operation member and rotated a separating and discharging member, thereby discharging the goods from an unloading portion side. This known unloading toy was of a simple construction wherein the goods which have been put on the stand-by deck in advance are merely brought down from the unloading portion every time the traveling body passes the unloading side. Because this unloading toy itself did not have a mechanism for lifting goods onto the stand-by deck, it was necessary to either use another goods lifting means for lifting goods onto the stand-by deck or lift goods manually. This was troublesome and not so interesting. As another problem, the mechanism for discharging the goods from the unloading portion side was complicated and difficult to operate and control. The present invention solves these above-mentioned and other problems according to the following and other objects and features of the invention.

SUMMARY OF THE INVENTION

An object of the present invention is to provide a lift toy which itself can lift and unload goods.

Another objection of the present invention is to discharge goods from an unloading portion side.

An additional object of the present invention is to provide a lift toy for discharging goods from an unloading portion side under control of a magnetic induction means.

In order to achieve the above-mentioned and other objects, the lift toy of the present invention includes a goods deck; a goods lifting member vertically movably mounted to the goods deck; lift means capable of being deformed and difficult to stretch, one end of the lift means being fixed to the goods deck and the other end thereof fixed to the goods lifting member; guide means provided at an upper portion of the goods deck to guide an intermediate portion of the lift means movably; and a raising/lowering handle for receiving movably an intermediate portion between the portion of the lift means fixed to the goods deck and the portion thereof guided by the guide means and raising and lowering the goods lifting member. When the raising/lowering handle is operated, the unloading member rises by an amount of displacement which is twice as large as the amount of displacement of the handle, so that player (child) can have the feeling of strangeness and interest.

A separating and discharging member is disposed for discharging a predetermined quantity of the goods from the stand-by portion. A contact-operation member rotates by force of contact of a traveling body passing by the unloading portion and causes the separating and discharging member to rotate by a predetermined angle through a rack and pinion mechanism. A retaining means disables rotation of the separating and discharging member to prevent discharge of the goods when the traveling body passes thereby. Magnetic induction means are provided to control the disabling performed by the retaining means.

The above-mentioned and other objects and features of the present invention will become apparent from the following description when read in conjunction with the accompanying drawings.

DESCRIPTION OF THE PREFERRED EMBODIMENTS

Figure 1:
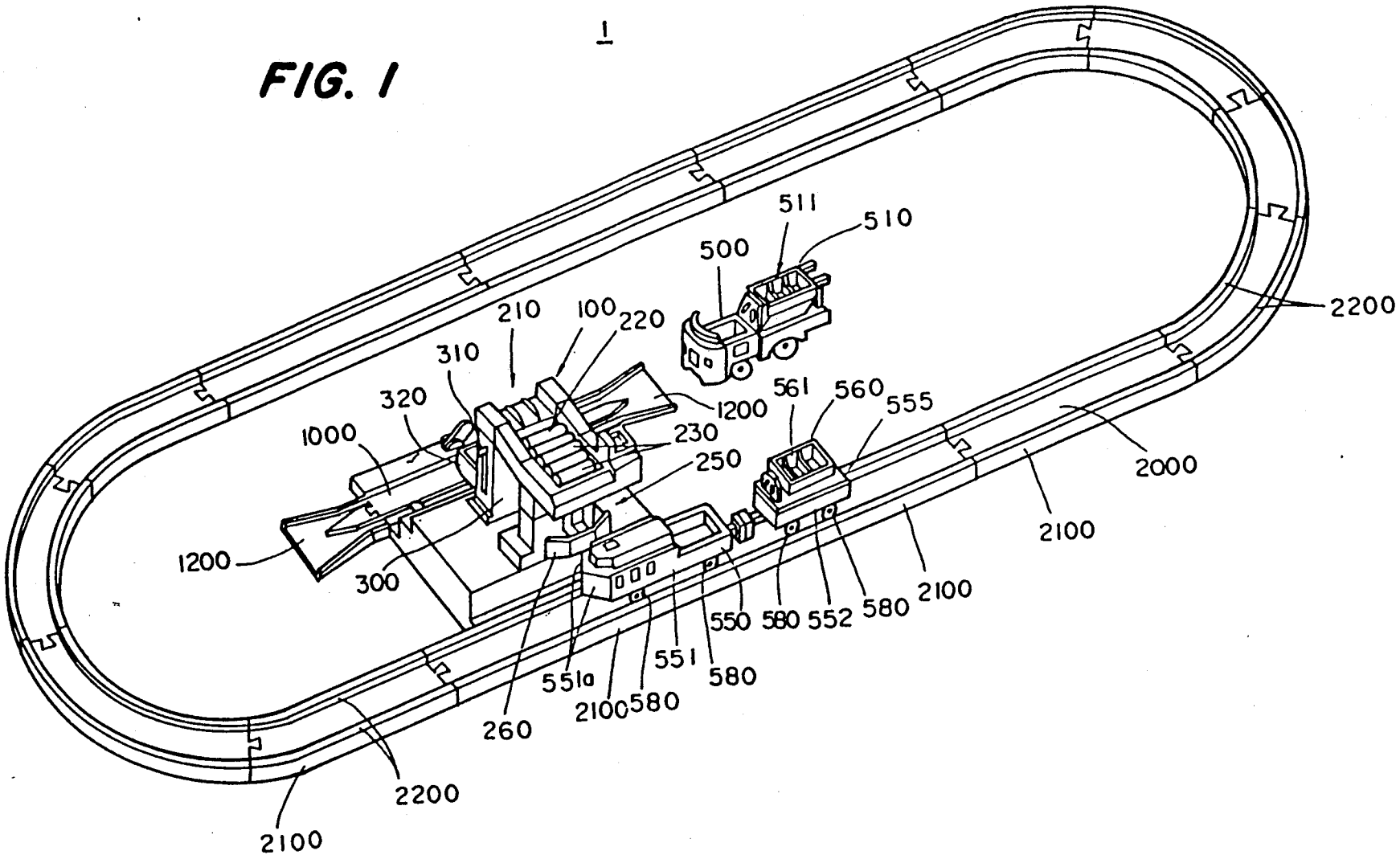
FIG. 1 is a perspective view of a track toy including a lift toy.

FIG. 1 is an entire perspective view of a track toy 1 to which is applied a lift toy 100 according to an embodiment of the present invention. The lift toy 100 is disposed along a central portion of a second track 2000 of the track toy 1. The lift toy 100 is provided with a goods lifting portion 210 for lifting goods 230 which have been carried on a first track 1000 by an unloading travel toy 500. A stand-by portion 220 holds goods 230 lifted by good lifting portion 210. A loading portion 250 loads goods 230 held on stand-by portion 220 onto a loading travel toy 550 which travels on a second track 2000.

The unloading travel toy 500 and the loading travel toy are each provided with goods carrying portions 510 and 560. In the goods lifting portion 210 of the lift toy 100, a goods lifting member 320, normally in a lowered state, is raised by operation of a raising/lowering handle 310.

In the loading portion 250, the loading travel toy 550 contacts and presses against a contact-operation member 260 when traveling on the second track 2000. When the contact-operation member 260 is pressed, the goods 230 held on the stand-by portion 220 are discharged onto the goods carrying portion 560 of loading travel toy 550.

The track toy 1 of FIG. 1 is constructed as discussed above and is played in the following manner. First, the player causes the unloading travel toy 500 with goods 230 on the loading portion to travel on the first track 1000 and stop beside of the goods lifting portion 210 of the lift toy 100. Second, the player turns and tilts the loading portion 510 of the travel toy 500 towards the goods lifting portion 210 to transfer the goods onto the lowered goods lifting member 320. Third, the raising/-lowering handle 310 is lowered to raise the goods lifting member 320. When the goods lifting member 320 is raised to reach the upper stand-by portion 220, it tilts to discharge the goods 230 onto the stand-by portion 220. The discharged goods 230 then roll on the stand-by portion 220 towards the loading portion until stopping in a stand-by state.

After the stand-by state is obtained, the player puts the loading travel toy 550 having an empty goods carrying portion 560 onto the second track 2000 and causes it to travel past the loading portion 250 of the lift toy 1000. As a result, a side portion of the toy 550 abuts and causes to rotate the contact-operation member 260 of the loading portion 250. When the contact-operation member 260 rotates, one of the goods 230 held on the stand-by portion 220 is discharged onto the goods carrying portion 560 of the travel toy 550 through the loading portion 250.

Thus, the goods 230 which have been conveyed up on the goods lifting portion 210 by the unloading travel toy 500 are carried onto the stand-by portion 220 by the goods lifting member 320 which is moved vertically by the raising/lowering handle 310. If a lot of goods are carried in this way and held on the stand-by portion 220, the held goods 230 are loaded, one by one, onto the goods carrying member 560 every time the loading travel toy 550 on the second track 2000 passes the loading portion 250 of the lift toy 100.

Figure 2:
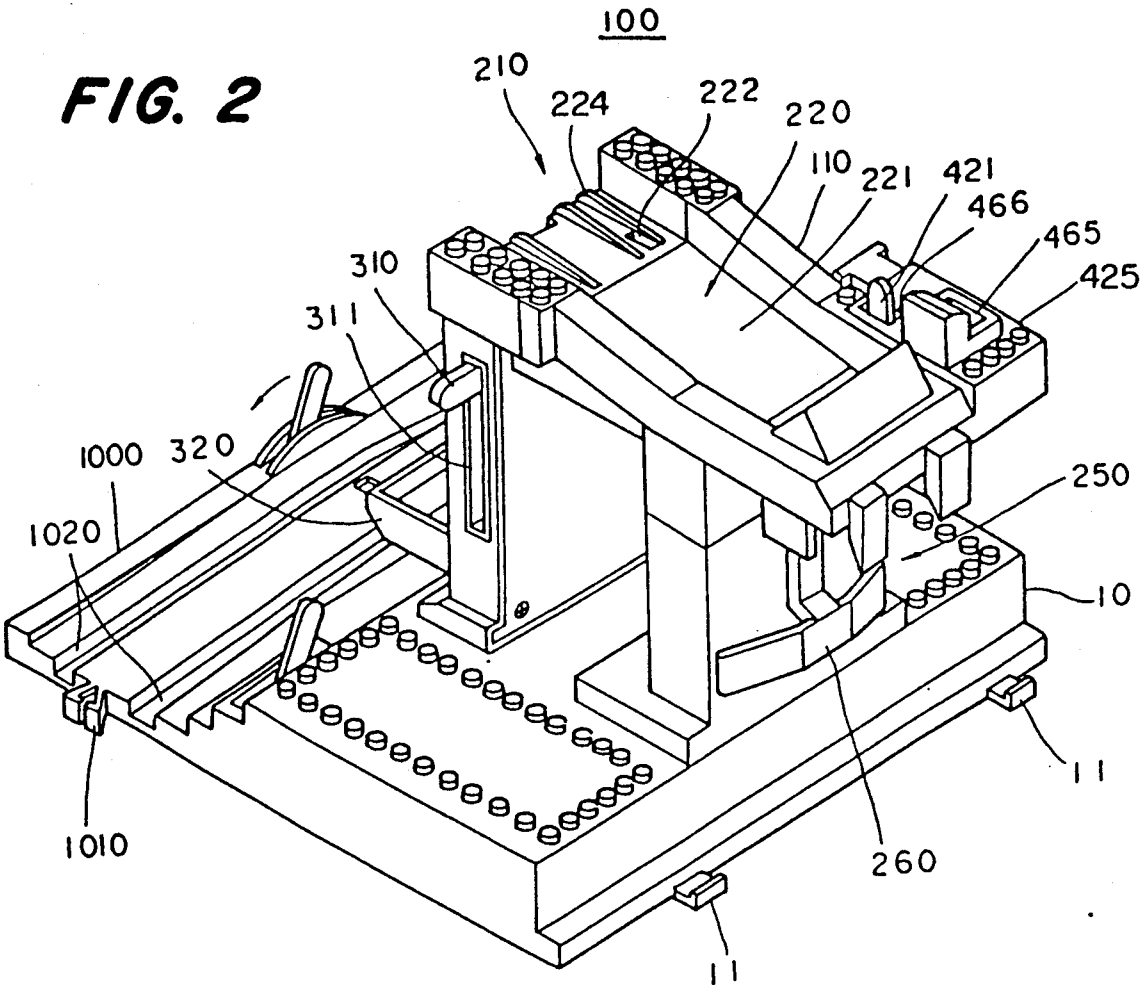
FIG. 2 is a perspective view of the lift toy.

As illustrated in FIG. 2, the lift toy 100 is provided with a base 10, on which is erected a goods deck 110. The base 10, which supports the goods deck 110, is mounted along the tracks 1000 and 2000. The base 10 is provided at one side portion thereof with mounting pieces 11 for mounting the second track 2000. Further, connecting tracks 1200 which constitute an inlet and an outlet of the first track 1000 are connected to the front and rear portions of the first track through connections 1010, as shown in FIG. 1. One track piece 2100, as a constituent of the second track 2000, is attached through the mounting pieces 11 to the base 10 on the side where those mounting pieces are provided. With this track piece 2100 as a base, a large number of track pieces 2100 are connected together as shown in FIG. 1 to constitute a loop-like second track 2000. The tracks 1000 and 2000 are formed with travel guide grooves 1020 (FIG. 2) and 2200 (FIG. 1), respectively, to prevent transverse movement of wheels 501 and 580 of the travel toys 500 and 550 traveling on those tracks.

The goods deck 110 is a deck for receiving goods 230 from the unloading travel toy 500, which has traveled on the first track 1000 allowing the goods to stand-by and thereafter loading them onto the loading travel toy 550 which travels on the second track 2000. The goods deck 110 is erected on the base 10.

The goods deck 110 has a predetermined height. It is provided with the goods lifting portion 210 at a side portion thereof on the first track 1000 side, the stand-by portion 220 at the upper end thereof and further provided with the loading portion 250 at a side portion thereof on the second track 2000 side. The goods lifting portion 210 is for receiving the goods 230 which have been carried to the first track 1000 side by the unloading travel toy 500 and lifting them onto the stand-by portion 220.

Figure 3:
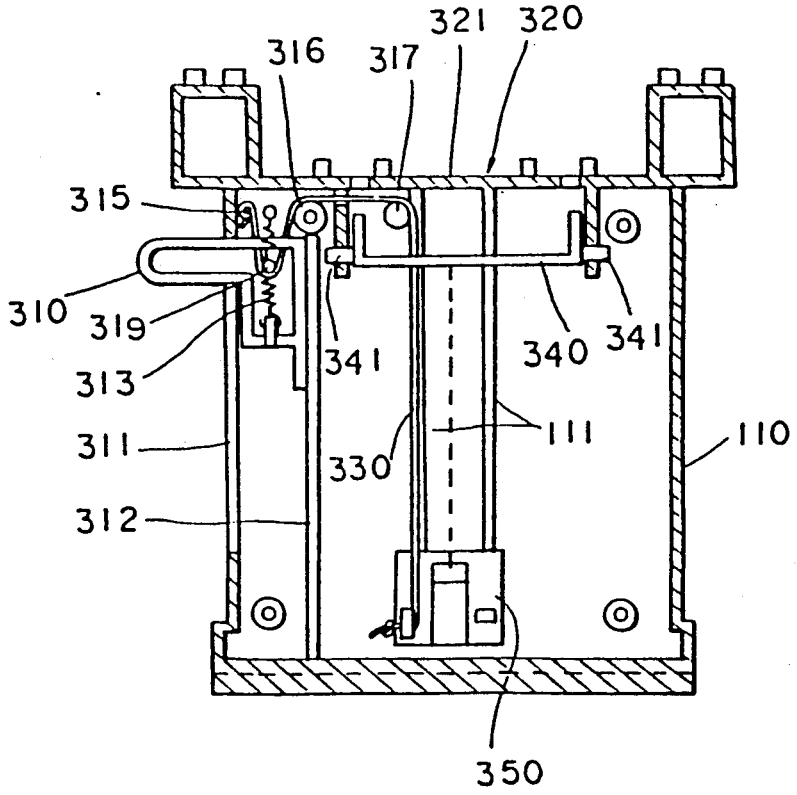
FIG. 3 is a vertical sectional view of an unloading portion of the lift toy.

As illustrated by FIG. 3, the goods lifting portion 210 provides the raising/lowering handle 310 mounted vertically movably along a vertically long guide slot 311. The goods lifting member 320 moves up vertically by force transmitted through a string 330 from the raising /lowering handle 310 moved down vertically. A direction adjusting member 340 projects onto the stand-by portion 220 when the goods lifting member 320 rises and performs a turning motion for discharging the goods 230 contained therein onto the stand-by portion 220. The direction adjusting member 340 aligns the direction of the goods 230 before discharging them onto the stand-by portion 220.

The raising/lowering handle 310 is vertically movably guided between a slide guide plate 312 erected in the interior of the goods deck 110 and a vertically long guide slot 311 formed at one side portion of the goods deck. The handle 310 is given an upward return force by a return spring 313.

The string 330 transfers the vertical motion of the raising/lowering handle 310 to vertically move the goods lifting member 320. One end of the string 320 is fixed to a pin 315 projecting above the handle 310 in the interior of the goods deck 110. The other end of the string 330 is secured to a support member 350 which rotatably supports the goods lifting member 320. The string 330 is guided to slidably travel along an intermediate portion by quide pins 316 and 317 provided in upper positions within the goods deck 110. A intermediate part of the string 330, between the portion fixed to the pin 315 and the portion guided by the guide pin 316, is engaged to slidably travel about a pin 311 provided integrally with the raising/lowering handle 310. Under this construction, the support member 350 raises twice as far as the distance displaced by the lowering of the handle 310. The support member 350 supports the goods lifting member 320 so that they both rise together. A pair of guide pieces 111 provided in the interior of the goods deck 110 guide the support member 350.

Figure 4:
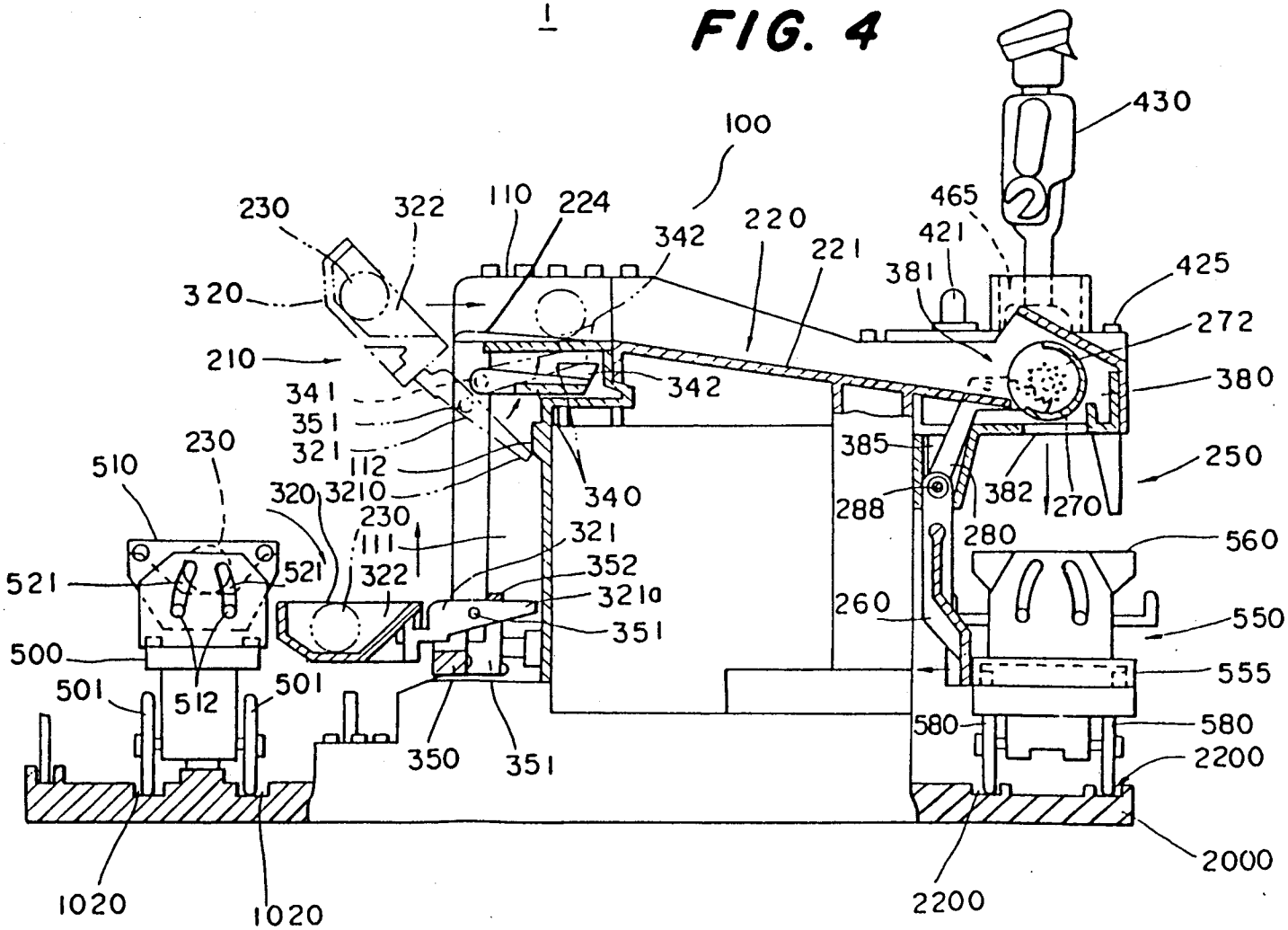
FIG. 4 is a side view of a partial vertical section of the track toy including the lift toy.

As illustrated in FIG. 4, the goods lifting member 320 has a receiving portion 322 connected to a base portion 321. The base portion 321 is pivotably mounted to the support member 350 by a pin 351. A pivotal range restricting opening 351 is formed in the support member 350. The base portion 321 has an extension **321*a* which extends within the pivotal range restricting opening 351. Normally, the goods lifting portion 320 provides a downward return force by its own weight. The downward force pivots extension 321*a* on pin 151 and returns it to a horizontal position. An upper edge 352 of the pivotal range restricting opening 351 provides a stop for the extension 321*a* and prevents the base portion 321** from pivoting beyond returning to the horizontal position.

On an upper inner wall portion between the pair of guide pieces 111, a contacting protuberance 112 is formed in the interior of the goods deck 110. The contacting protuberance pushes down on the extension **321*a* when the goods lifting member 320 rises. Accordingly, the base portion 321 upwardly pivots the receiving portion 322, as indicated by the dashed line in FIG. 4**.

In the upper portion of the goods lifting portion 210 of the goods deck 110, the direction correcting member 340 is pivotably mounted on pins 341 projecting from both right and left sides of the direction adjusting member 340. Because the goods 230 are not perfectly aligned in the receptacle portion 322, when discharged from the receptacle portion 322 of the goods lifting member 320, the direction adjusting member 340 is provided. The direction adjusting member 340 aligns the direction of goods 230 by pivoting on pins 341 to project direction correcting pawls 342 up and out of openings 222 in the surface of the stand-by portion 220. Direction correcting pawls 342 are provided on both right and left sides on the upper front end portion of the direction correcting member 340. When the direction correcting member 340 pivots and its front end side rises, as indicated by the dashed line in FIG. 4, the direction correcting pawls 342 project up and out of openings 222 formed in the surface of the stand-by portion 220 close to both right and left side on an inlet side of the stand-by portion 220. The direction adjusting member 340 is normally retracted with the direction correcting pawls 342 hidden below the stand-by portion 220, as indicated by a solid line in FIG. 4.

Figure 5:
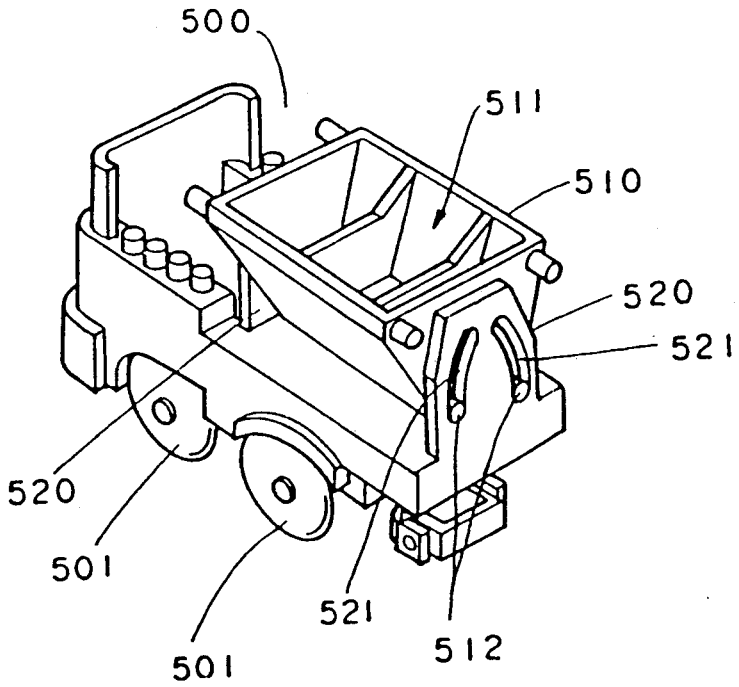
FIG. 5 is a perspective view of an unloadable travel toy for traveling on the track.

As illustrated in FIG. 5, the unloading travel toy 500 is provided in the front and in the rear with two pairs of right and left wheels 501. The wheels 501 are constructed for guide travel in the travel guide grooves 1020 of the first track 1000. The unloading travel toy 500 carries the goods 230 to the goods lifting portion 210 of the lift toy 100 and transfers them onto the goods lifting member 320 when the goods lifting member 320 is in a lowered state. On an upper rear portion of the unloading travel toy 500 a goods carrying member 510 is mounted so that it can be tipped towards either right or left sides of the unloading travel toy.

The goods carrying member 510 has a receiving portion 511 having an upper opening for receiving the goods 230 therein. A pair of right and left movable pins 512 project from the lower side of each of the front and rear ends of the receiving portion 511. Arcuate guide holes 521 are formed in bearing plates 520 erected on the unloading travel toy 500. The front and rear movable pins 512 are guided when moving through the arcuate guide holes 521 so that the player can turn the goods carrying member 510 in both right and left directions.

With goods in the loading portion 510, the unloading travel toy 500 travels on the first track 1000 until it reaches the goods lifting portion 210. Then, by turning the goods carrying member 510 in a direction towards the unloading member 320, the goods 230 are transferred into the receiving portion 322 of the goods lifting member 320. Thereafter, the support member 350 is raised together with the goods lifting member 320 by operating the raising/lowering handle 310, whereby the support member 350 and the goods lifting member 320 are raised by an amount of vertical displacement which is twice as large as the amount of displacement of the handle. With this upward movement, the extension 321*a* on the base portion 321 side of the goods lifting member 320 comes into contact with the contacting protuberance 112 formed on the upper inner wall portion between the guide pieces 111 in the interior of the goods deck 110. Then, the goods lifting member 320 is turned in a rising direction of its receiving portion 322 side and discharges the goods 230 contained therein onto the stand-by portion 220. Thereafter, the upper edge 352 of the pivotal range restricting opening 351 of the support member 350 comes into abutment with the lower surface on the free end side of the direction adjusting member 340. This causes the direction correcting member to turn in a rising direction of its front end side (free end side) and the direction correcting pawls 342 to project upward through the openings 222 in the upper surface of the stand-by portion 220. The direction of the goods 230 discharged onto the stand-by portion 220 are adjusted into a straight sideways turned state so that the goods can more easily roll. Thereafter, when the raising/lowering handle 310 is released, the return spring 313 pulls the handle upward while the support member 350 and the goods lifting member 320 are let down by the string 330 under the force of their own weight. As a result, the goods lifting member 320 and the direction correcting member 340 revert to their normal positions and the goods 230 are disengaged from the direction adjusting member 340 and roll toward the loading portion 250 which will be later described below with respect to FIGS. 6 and 7.

The stand-by portion 220 is provided at the upper end of the goods deck 110 and holds the goods 230. A central portion of the stand-by portion 220 includes a gently inclined portion 221 sloping down from the goods lifting portion 210 toward the loading portion 250. On an inlet side of the stand-by portion 220 the openings 222 are provided for the direction correcting pawls 342. A plurality of sloping ridges 224 are formed in parallel relationship alongside openings 222.

As illustrated in FIG. 4, the loading portion 250 loads the goods 230 held on the stand-by portion 220 into the goods receiving member 560 of the loading travel toy 550. The goods 230 are loaded, one by one, at every arrival of the loading travel toy 550. The loading portion 250, provided in the goods deck 110 opposite to the unloading portion 210, has a discharge portion 380 projecting beyond the stand-by portion 220 and over the second track 2000. A separating and discharging member 270 discharges, one by one, the goods 230 held on the stand-by portion 220. A rack member 280 rotates the separating and discharging member 270 when the contact-operation member 260 moves under the force of contact with the loading travel toy 550.

Figure 6:
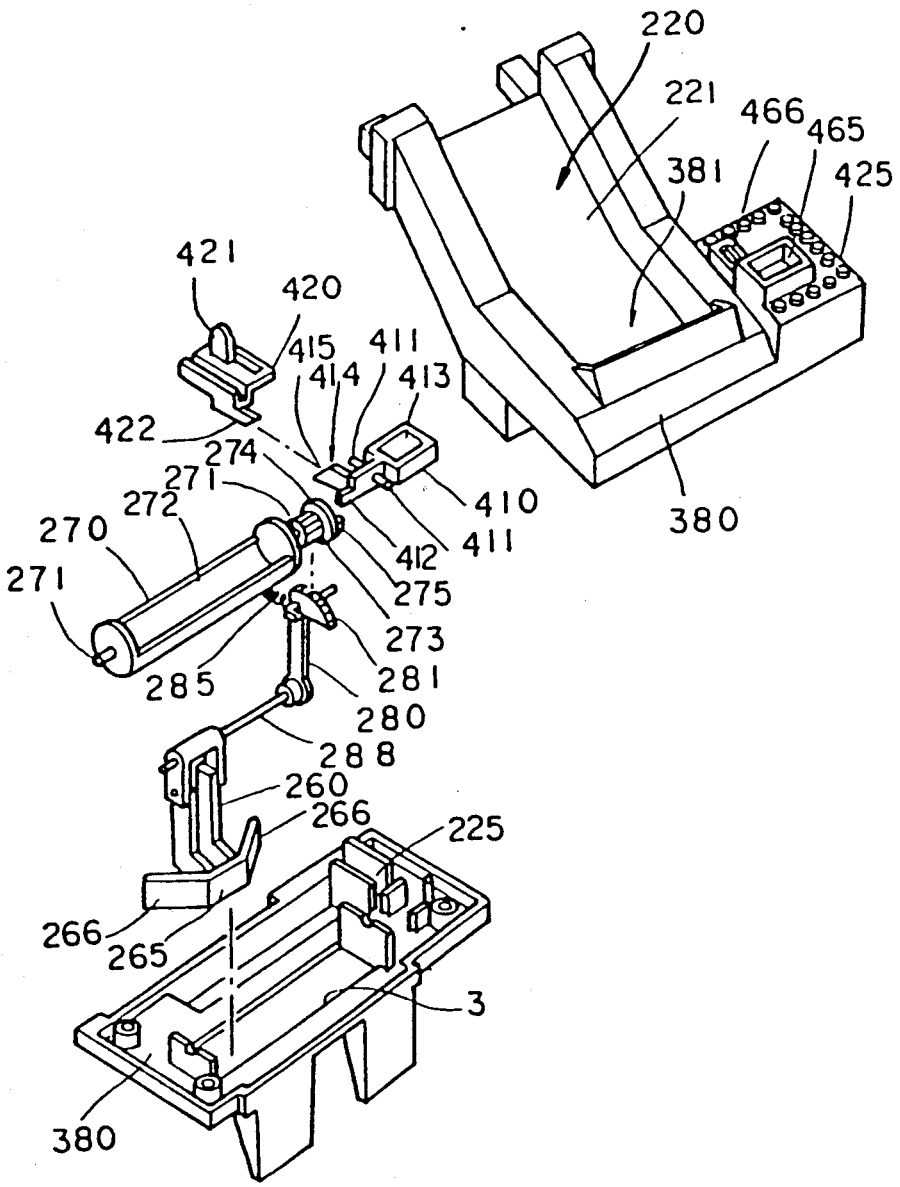
FIG. 6 is a perspective view of a loading portion of the lift toy.
Figure 7:
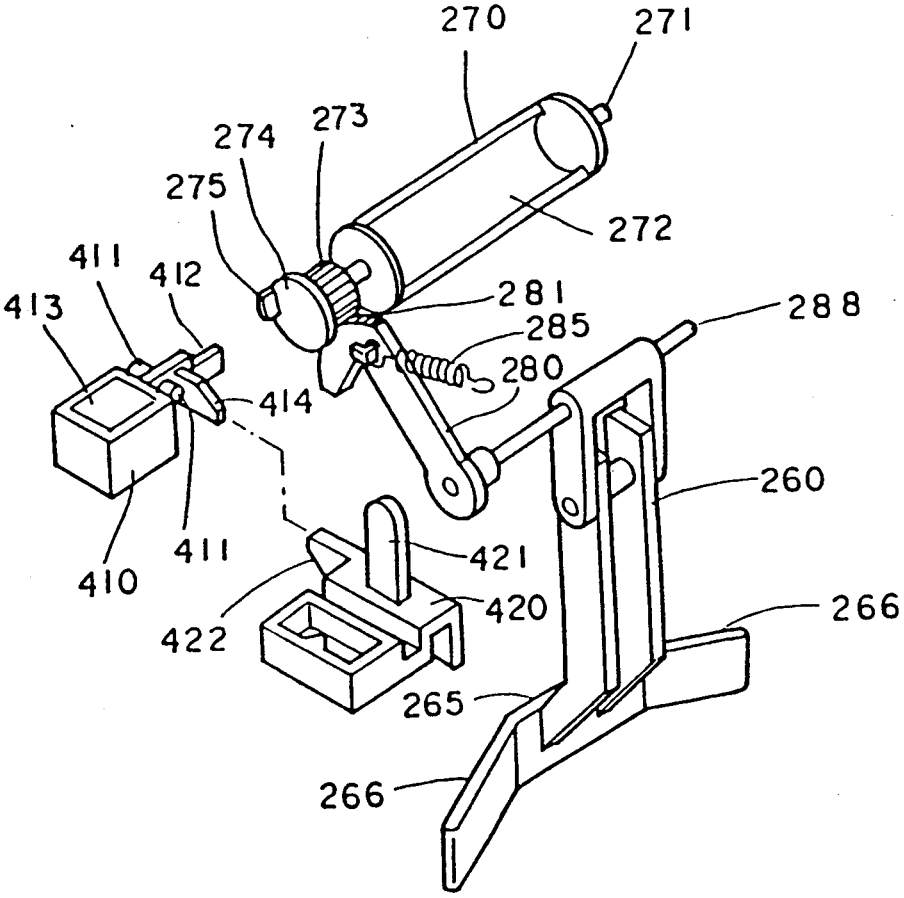
FIG. 7 is an exploded view showing an internal mechanism of the loading portion of the lift toy.

As illustrated in FIG. 6, a retaining member 410 is mounted in an operating portion 425 adjacent to the discharge portion 380. The retaining member 410 retains the separating and discharging member 270 and a first disengaging member 420 for disengaging the separating and discharging member 270 from the retaining member 410. Further, a second disengaging member 430 (man in FIG. 4) disengages the separating and discharging member 270 from the retaining member 410 when received in a concave portion 465 formed in the operating portion 425.

The discharge portion 380 discharges the goods 230 from the stand-by portion 220 into the goods receiving member 560 of the loading travel toy 550. The discharge portion 380 projects over the second track 2000 and from the stand-by portion 220.

The separating and discharging member 270, mounted in the discharge portion 380, discharges the goods 230 from a discharge port 382 after the goods have entered an inlet port 381. The separating and discharging member 270 is rotatably mounted within the discharge portion 380 about support shafts 271. The separating and discharging member 270 is provided with a semicircular receiving portion 272 for separating the goods 230, one by one, and discharging them from the discharge port 382.

A pinion gear 273 meshes with rack teeth 281 of the rack member 280. The support shaft 271 has the pinion gear 273 integrally mounted on one end side of the separating and discharging member 270. An engaging piece 275 and a disk 274 are integrally mounted on the pinion gear 271 as illustrated in FIG. 6. The retaining member 410 and the first disengaging member 420 are mounted in the interior of the operating portion 425 adjacent to the discharge portion 380 in which is accommodated the engaging piece 275.

The retaining member 410 and the first disengaging member 420 are mounted in the interior of the operating portion 425. The retaining member 410 contacts the engaging piece 275. The retaining member 410 selectively prevents rotation of the separating and discharging member 270 when in contact with the engaging piece 275. The retaining member 410 is pivotably mounted on pins 411. On the front end side of the retaining member 410, an engaging portion 412 is provided which selectively contacts the engaging piece 275 of the separating and discharging member 270. On the base end side of the retaining member 410, a permanent magnet 413 is embedded. A retaining portion 414 is provided on the side of the retaining member 410 near the engaging portion 412. The retaining portion 414 has a slanted face and is capable of coming into face-to-face contact with a slanted face of a contact portion 422 of the first disengaging member 420 which will later be described below.

The engaging portion 412 of the retaining member 410 normally pivots upward by the downward force of the weight of the permanent magnet 413. When, as shown in FIG. 4, the separating and discharging member 270 is in a position where the opening side of the receiving portion 272 faces the inlet port 381, the engaging portion 412 contacts the engaging piece 275 to prevent rotation of the separating and discharging member 270. It is the left side portion, as shown in FIG. 6, of the engaging portion 412 which contacts a clockwise-side end face of the engaging piece 275 of the separating and discharging member 270 when the engaging piece 275 has assumed a high position. This prevents rotation in the clockwise direction as defined by FIG. 7 or the counterclockwise direction as defined by FIG. 4 of the separating and discharging member 270. When the engaging portion 412 of the retaining member 410 pivots downward by either face-to-face contact of the slanted face of the retaining portion 414 with the slanted face of the contact portion 422 or by an upward magnetic force provided by the second disengaging member 430 pulling against the permanent magnet 413, the engaging portion 412 descends to a position near the center of the disk 274 and cannot contact the engaging piece 275 of the separating and discharging member 270. Therefore, the first and second disengaging members 420 and 430 determine whether the separating and discharging member 270 can rotate in a clockwise direction as defined by FIG. 7 or a counterclockwise direction as defined by FIG. 4.

The first disengaging member 420 disengages the separating and discharging member 270 from the retaining member 410. The first disengaging member 420 is slidably mounted in the interior of the operating portion 425. At the lower front end of the first disengaging member 420 there is provided the contact portion 422 which has a slanted face and is capable of face-to-face contact with the slanted face of the retaining portion 414 of the retaining member 410. A switch handle 421 for sliding the disengaging member 420 upwardly projects outside the operating portion 425 through a long hold formed in the upper surface of the operating portion 425.

When the switch handle 421 slides the first disengaging member 420 away from the retaining member 410 in a retreated state, the contact portion 422 is incapable of face-to-face contact with the face of the contact portion 414 of the retaining member 410 and the second disengaging member 430 controls rotation of the separating and discharging member 270. When the switch handle 421 slides the first disengaging member 420 towards the retaining member 410, the engaging portion 412 pivots downward from the face-to-face contact and the separating and discharging member 270 can freely rotate. This occurs by the face of the contact portion 422 forcibly pushing up on the face of the contact portion 414 to bring the retaining portion 412 into engagement with the retaining piece 275 of the separating and discharging member 270, thereby preventing rotation of the separating and discharging member 270.

A disengaging member receiving portion 465, capable of receiving the second disengaging member 430, is provided in the operating portion 425 adjacent to the stand-by portion 220 in a position just above the base end portion of the retaining member 410. The second disengaging member 430 is preferably of a doll-shape, as shown in FIG. 4, which can be received in the receiving portion 465. The second disengaging member 430 contains a permanent magnet or magnetic material (not shown) embedded in each foot of the doll-shape. The second disengaging member 430 disengages the separating and discharging member 270 from the retaining member 410 when the permanent magnet or magnetic material in each foot of the doll-shape attracts the permanent magnet 413 embedded in the base end portion of the retaining member 410 and pivots retaining member 410.

When the second retaining member 430 is received in the retaining member receiving portion 465 of the operating portion 425, the permanent magnet 413 at the base end portion of the retaining member 410 is attracted to the magnetic material or permanent magnet (not shown) provided at the lower end of the retaining member 430, so that the base end side rises to disengage the separating and discharging member 270 from the retaining portion 412. Thus, by receiving the doll-shaped, second disengaging member 430 into the disengaging member receiving portion 465 of the operating portion 425, the separating and discharging member 430 becomes rotatable, giving rise to an impression as if the discharge of the goods 230 from the discharge portion 38 were controlled by a person represented by the doll.

The rack member 280 transfers a rotating force from the contact-operation member 260, which will be described later, to the separating and discharging member 270. A base portion of the rack member 280 is fixed onto a pivot shaft 288 whereby the rack member 280 is made pivotable. The pivot shaft 288 is transversely mounted in the rack member receiving portion 385 of the discharge portion 380. Rack teeth 281 formed at the front end of the rack member 2890 mesh with the pinion gear 273 of the separating and discharging member 270. The rack member 280 is preferably given a pivotal return force in the counterclockwise direction (as defined by FIG. 4) by a return spring 285.

The contact-operation member 260 transfers the contact force of the loading travel toy 550, traveling on the second track 2000, to the rack member 280. The contact-operation member 260 has a base portion fixed onto the pivot shaft 288 which is mounted the rack member 280. At the lower end (free end) of the contact-operation member 260, a vehicle contact portion 265 is provided which projects towards the second track 2000. The vehicle contact portion 265 is provided with angled contact guide portions 266.

The loading travel toy 550, as illustrated in FIG. 1, is a vehicle which receives goods 230 from the loading portion 250 of the lift toy 100. The loading travel toy 550 is composed of a traction vehicle 551 and a freight vehicle 552 pulled by the traction vehicle 551. The loading travel toy 550 travels along the second track 2000 on the wheels 580. The traction vehicle 551 is provided on the right and left front sides thereof with slanted face-like contact portions 551*a* for contact with the vehicle contact portion 265 of the contact-operation member 260 mounted on the loading portion 250 of the lift toy 100. On the rear portion of the freight vehicle 552 is mounted the goods carrying member 560. Like the goods carrying member 510 of the unloading travel toy 500, the goods carrying member 560 is provided with a receiving portion 561 and has the same construction as that of the goods carrying member 510 so that it can be tipped in both right and left directions.

After a lot of goods 230 are loaded onto the stand-by portion 220 of the goods deck 110, either the first disengaging member 420 is retreated, or the second disengaging member 430 is received into the receiving portion 465 of the operating portion 425, to make the separating and discharging member 430 in the discharge portion 380 rotatable. Then, the loading travel toy 550, with its empty goods carrying portion 560, is put on the second track 2000. When the loading travel toy 550 travels and passes the loading portion 250, the front-side contact portion 51*a* of the traction vehicle 551 of the travel toy 550 abuts the vehicle contact portion 265 of the contact-operation member 260 and pushes against the contact-operation member 260. With this force against the contact-operation member 260, the rack member 280 is turned clockwise, as defined by FIG. 4, and the separating and discharging member 270 is rotated counter-clockwise as again defined by FIG. 4, so that the opening side of the receiving portion 272 faces downwards to discharge the goods 230 contained therein. At this time, the remaining goods on the stand-by portion 220 are held in the stand-by state against the outer periphery of the separating and discharging member 270.

When the goods 230 are discharged, if the freight vehicle 552 of the loading travel toy 550 arrives at the loading portion 250 at an appropriate timing, the goods 230 are loaded onto the goods carrying member 560 of the freight vehicle 552. When the freight vehicle 552 of the loading travel toy 550 has passed beyond the contact-operation member 260 of the loading portion 250, the force of the return spring 285 pulls the contact-operation member 260 and the rack member 280 to their normal positions. When in their normal positions, the contact portion 265 of the contact-operation member 260 projects over the second track 2000 side and the receiving portion 272 of the separating and discharging member 270 faces the inlet port 381 so that more goods 230 can be received by the receiving portion 272. In this way, the goods 230 on the stand-by portion 220 are discharged, one by one, onto the goods carrying member 560 from the discharge portion 380 every time the loading travel toy 550 passes the loading portion 250.

The goods on the stand-by portion 220 are not to be discharged from the discharge portion 380, when the first disengaging member 420 is retreated and the second disengaging member 430 is not received in the receiving portion 465. As a result, the separating and discharging member 270 is locked into the position shown in FIG. 4 and hence the goods 230 are not discharged from the discharge portion 380.

The lift toy 100 according to this embodiment, as set forth above, is provided with the goods deck 100; the goods lifting member 320 vertically movably mounted in the goods deck 110; the string 330 having one end attached to the goods deck 110 and an opposite end attached to the goods lifting member 320; the guide pins 316 and 317 as support means provided in upper positions of the goods deck 110 to support an intermediate portion of the string 330 so that the string can travel; and the raising/lowering handle 310 which receives an intermediate portion between the portion of the string 33 attached to the goods deck 110 and the portion thereof guided by the guide pins 316. Traveling of the said intermediate portion which raises or lowers the goods lifting member 320 is thus permitted. Under this construction, when the raising/lowering handle 310 is operated, the goods lifting member 320 rises by an amount of displacement twice as large as the amount of displacement of the handle 310. Consequently, a player, such as a child, can have a feeling of strangeness and interest.

In the lift toy 100, moreover, the discharge portion 380 is provided in the loading portion 250, and the separating and discharging member 270 is mounted in the discharge portion 380. The separating and discharging member 270 is rotated by the rack member 280 adapted to integrally rotate with the contact-operation member 260. When the loading travel toy 550, traveling on the second track 2000, presses against the contact operation member 260, the contact operation member 260 is rotated and the goods 230 are discharged from the discharge portion 380. Therefore, every time the loading travel toy 550 passes the loading portion 250, the goods on the stand-by portion 220 are discharged onto the goods carrying member 560 from the discharge portion 250 causing the player to have a feeling of strangeness and interest.

When the second disengaging member 430 is received in the receiving portion 465, the retained state of the separating and discharging member 270 is released by magnetic attraction of the magnetic material or permanent magnet at the lower end of the second disengaging member 430 and the permanent magnet 413 of the retaining member 410 and the goods 230 can be discharged from the discharge portion 280. Consequently, there is created an impression as if a conversion into a dischargeable state of the goods 230 had been automatically made by the second disengaging member 430 on the operating portion 425 causing the player to have a feeling of strangeness and interest.

In the above embodiment the string 330 is used as an example of a lift means. Any deformable, difficult to stretch and elongated lift means may be used. The guide pins 316 and 317 are examples of means for guiding an intermediate portion of the lift means so as to permit traveling of the intermediate portion. Any type, e.g. pulley, and number of guide means can be used in place of the guide pins 316 and 317. The pin 311 is an example of the portion of the raising/lowering handle 310 which receives for traveling both the portion of the lift means attached to the goods deck 110 and the portion thereof guided by the guide means. A hole or a pulley can be used in place of the pin 311. The doll-shape of the second retaining member 430 is exemplary. Other shapes such as animals or things may be used for the second retaining member 430. The permanent magnet 413 is attached above to the retaining member 410 side and a magnetic material is attached above to the second retaining member 430 side as an example only. The permanent magnet 413 and the magnetic material can be exchanged with each other. Also, both the permanent magnet 413 and the magnetic material can be magnets, one being N pole and the other S pole. The first track 1000 on the second track 2000 need not always be attached to the lift toy 100. Further, it is not always necessary to use the direction correcting member 340. Additionally, the separating and discharging member 270 can discharge goods in any predetermined quantity.

A lift toy 100 according to the present invention includes a goods deck and a goods lifting member vertically movably mounted to the goods deck. One end of a string is fixed to the goods deck while an opposite end thereof is fixed to the goods lifting member. A guide is provided at an upper portion of the goods deck to movably guide an intermediate portion of the string. A raising/lowering handle movably receives an intermediate portion of the string between the portion fixed to the goods deck and the portion guided by the guide.

While the invention has been illustrated and described in detail in the drawings and foregoing description, it will be recognized that many changes and modifications will occur to those skilled in the art. It is therefore intended, by the appended claims, to cover any such changes and modifications as fall within the true spirit and scope of the invention.

What is claimed is:

1. A toy capable of lifting goods onto a stand-by portion comprising:

a vertically movable support member;

a lift member of unstretchably deformable material including a first end connected to a fixed position, a second, opposite end connected to said vertically movable support member and an intermediate portion, between the first and second ends, movably coupled to said raising/lowering handle; and a goods lifting portion pivotably supported by said vertical support member at a pivot point having:

a receiving portion located at one end radially extending from the pivot point; and extension means located at a second end radially extending from said pivot point for upwardly pivoting the receiving portion to empty the goods from said receiving portion onto the stand-by portion when said support member reaches a predetermined vertical distance.

2. A toy according to claim 1, further comprising:

a guide located below the stand-by portion and operatively coupled to said vertically movable support member.

3. A toy according to claim 2, wherein said toy further comprises a contacting protuberance located along said guide; and wherein said extension means further includes means for cooperating with said contacting protuberance when upwardly pivoting the receiving portion.

4. A toy according to claim 1, further comprising:

one of a pulley and a pin secured in a fixed position having said lift member cooperating therewith at the intermediate portion.

5. A toy according to claim 4, wherein said lift member includes a string.

6. A toy according to claim 1, further comprising:

a direction adjusting means for adjusting the direction of the goods after said support member reaches the predetermined vertical distance.

7. A toy according to claim 6, wherein said direction adjusting means comprises means for holding the goods after upwardly pivoting the receiving portion and before emptying the goods onto the stand-by portion.

8. A toy according to claim 6, wherein said direction adjusting means comprises a plurality of extendable pawls.

9. A toy according to claim 1, further comprising:

discharge means for discharging the goods from the stand-by portion in response to an object passing thereby.

10. A toy capable of lifting goods onto a stand-by portion and discharging the goods from the stand-by portion in response to an object comprising:

lift means for lifting and emptying the goods onto the stand-by portion;

contact means for providing a force when the object passes by said contact means;

discharging means for receiving goods from the stand-by portion and discharging the goods when said contact means provides the force; and retaining means for selectively disabling said discharging means, wherein said retaining means comprises a two-condition disengaging means for detecting an absence of a magnetic force, allowing positional placement of an actuator to a predetermined position thereby disabling said discharging means when both the absence of the magnetic force is detected and said actuator is not positionally placed to the predetermined position.

11. A toy capable of discharging goods from a stand-by portion in response to an object comprising:

contact means for providing a force when the object passes by said contact means;

separating and discharging means for rotatingly receiving goods of a predetermined quantity from the stand-by portion and discharging the goods when said contact means provides the force; and retaining means for selectively disabling said separating and discharging means, wherein said retaining means comprises a two-condition disengaging means for detecting an absence of a magnetic force, allowing positional placement of an actuator to a predetermined position, thereby disabling said separating and discharging means when both the absence of the magnetic force is detected and said actuator is not positionally placed to the predetermined position.

12. A toy according to claim 11, further comprising a doll-shaped member for providing the magnetic force by cooperating with said two-condition disengaging means.

13. A toy according to claim 12, wherein said doll-shaped member comprises one of a permanent magnetic or a magnetic material.

14. A toy according to claim 11, further comprising:

lift means for lifting and emptying the goods onto the stand-by portion.

* * * * *

UNITED STATES PATENT AND TRADEMARK OFFICE

CERTIFICATE OF CORRECTION

PATENT NO. : 5,131,881

DATED : July 21, 1992

INVENTOR(S) : Okada

It is certified that error appears in the above-identified patent and that said Letters Patent is hereby corrected as shown below:

Title page, [56] "Ogagawara" should be --Ogasawara--;

between lines 10 and 11 (below "4,312,149") insert
-- 4,359,837 11/1982 Hool.....446/171 --.

Title page, Col. 2, after line 2 ("23333410"), insert
-- 1,571,645 7/1980 Europe
2,063,084 6/1981 UK
2,074,462 11/1974 UK --.

Col. 4, line 26, "quide" should be --guide--.

Col. 10, line 16, "33" should be --330--.

Signed and Sealed this

Nineteenth Day of October, 1993

Bruce Lehman

*Attest:*

BRUCE LEHMAN

*Attesting Officer*

*Commissioner of Patents and Trademarks*